US005252041A

United States Patent [19]

Schumack

[11] Patent Number: 5,252,041

[45] Date of Patent: Oct. 12, 1993

[54] AUTOMATIC CONTROL SYSTEM FOR DIAPHRAGM PUMPS

[75] Inventor: Russell Schumack, Shenandoah, Pa.

[73] Assignee: Dorr-Oliver Incorporated, Milford, Conn.

[21] Appl. No.: 876,837

[22] Filed: Apr. 30, 1992

[51] Int. Cl.[5] ..... F04B 43/06

[52] U.S. Cl. ..... 417/395; 417/46

[58] Field of Search ..... 417/395, 46; 91/1, 419, 91/333, 435, 366

[56] References Cited

U.S. PATENT DOCUMENTS

| | | | |
|---|---|---|---|
| 3,814,548 | 6/1974 | Rupp | 417/395 |
| 4,212,589 | 7/1980 | Bosio | 417/12 |
| 4,265,600 | 5/1981 | Mandroian | 417/395 |
| 4,705,462 | 11/1987 | Balembois | 417/395 |
| 4,765,225 | 8/1988 | Birchard | 41/435 |
| 4,856,969 | 8/1989 | Forsythe et al. | 417/395 |
| 4,966,528 | 10/1990 | Henkel et al. | 417/63 |
| 4,990,058 | 2/1991 | Eslinger | 417/46 |
| 5,076,890 | 12/1991 | Balembois | 162/198 |

*Primary Examiner*—Richard A. Bertsch
*Assistant Examiner*—Alfred Basichas
*Attorney, Agent, or Firm*—Harold M. Snyder

[57] ABSTRACT

A method and apparatus for controlling the discharge time of a fluid activated diaphragm pump. The control system regulates the discharge time, by measuring the discharge time and comparing the measured time with a predetermined desired discharge time. The control system includes, inter alia, a programmable logic controller, an upper and lower proximity switch, a target, a rod to hold the target, a pilot controlled pressure regulator, a set of digitally controlled solenoids which control a pilot valve, a solenoid, and a pressure switch. The rod is secured to the diaphragm of the diaphragm pump, and the proximity switches respond to the movement of the rod to detect the movement, or stroke, of the diaphragm. The pressure supplied to the diaphragm pump is automatically, and continuously, adjusted to maintain a desired discharge time.

9 Claims, 1 Drawing Sheet

AUTOMATIC CONTROL SYSTEM FOR DIAPHRAGM PUMPS

BACKGROUND OF THE INVENTION

The present invention relates to a control system, and method of operating same, for controlling the application of pressure to a diaphragm pump. The system automatically, and continuously, adjusts the pressure utilized in actuating the diaphragm within the diaphragm pump so as to maintain a constant flow of the fluid passing through the diaphragm pump.

Conventional prior art industrial control systems, that are currently utilized with diaphragm pumps, require that a pressure regulator be manually adjusted. Consequently, if the discharge conditions change, the pressure regulator must be changed by manual manipulations performed by a human operator.

As can readily be appreciated, failure to properly adjust the diaphragm pump results in inefficient operation of the pump. For example, if the pressure regulator is set too low for the discharge conditions, incomplete pump strokes with a resultant low flow rate will occur. Conversely, if the pressure regulator setting is too high for the discharge conditions, the pump may be damaged. The instant control system overcomes these deficiencies by automatically, and continuously, adjusting the pressure setting to produce proper operating conditions and obviates the need for a human operation to monitor and manually adjust the pressure regulator. The control package, and the diaphragm pump operated thereby, find particular application in filling a fixed volume in which the pressure increases as the volume is filled; an exemplary application would be found in a plate and frame filter press, although several other applications are envisioned.

U.S. Pat. Nos. 4,705,462 and 5,076,890, both granted to Balembois and both assigned to the assignee of the present invention, are illustrative of known methods utilized to control the pumping action of a fluid actuated diaphragm pump. Balembois '462 utilizes a sensing structure which is implemented to control the functional parameters of the diaphragm pump. For example, such arrangement controls the initiation and duration of applied fluid pressure, the discharge time and the complete cycle time. Balembois '890 is an improvement over the earlier Balembois '462 patent. In addition to sensing the cycle time of the diaphragm pump, the apparatus measures the volumetric flow rate, and adjusts the cycle time to correct any deviations from a predetermined volumetric flow rate.

The use of control systems in an artificial blood circulation assembly is disclosed by Bosio in U.S. Pat. No. 4,212,589. The apparatus includes a pump having a fluid driven tubular member. The fluid driving pressure is automatically regulated based upon the opening and closing of a timing switch. The timing switch is operated by a feeler which follows the deformation of the tubular member as fluid pressure acts on the tubular member. The feeler operates the switch to close the circuit of an optical signalling device when deformation of the tubular membrane reaches a predetermined value.

U.S. Pat. No. 4,966,528, to Henkel et al. discloses an apparatus for controlling the hydraulic circuit of a piston diaphragm pump. The apparatus includes a sensor for measuring the length of the stroke travel of the diaphragm and generating a corresponding stroke travel signal that is transmitted to a control means. The control means then compares the stroke travel signal with the predetermined stroke values. If the stroke travel signal deviates from the predetermined stroke values, the amount of hydraulic medium per time unit is accordingly adjusted.

U.S. Pat. No. 4,856,969, to Forsythe et al, discloses a diaphragm pump having a timer for controlling the cycle time of the diaphragm pump and an adjustable pressure regulator. Additionally, Ruoo (U.S. Pat. No. 3,814,548) and Mandroian (U.S. Pat. No. 4,265,600) disclose diaphragm pumps having regulation assemblies.

BRIEF SUMMARY OF THE INVENTION

The method and apparatus of the instant invention pertain to a control system that automatically, and continuously, regulates the fluid pressure applied to a diaphragm pump to control the discharge time of the pump. The control system utilizes a programmable logic controller which acts to integrate the complete control system. The cycle and discharge time of the diaphragm pump are the primary parameters which the programmable logic controller considers, while it regulates the control system. Spaced proximity switches measure the cycle and discharge times. These proximity switches are actuated by a proximity switch target that is attached to a rod mechanically fastened to the diaphragm. This information is inputted into the programmable logic controller, which then compares the actual discharge time with the desired discharge time. Depending upon the deviation from the desired discharge time, the programmable logic controller automatically adjusts the pressure regulator that supplies fluid pressure to the diaphragm. The control system continuously monitors the diaphragm pump, such that the proper pressure is automatically supplied to the diaphragm to insure that the pump operates in the most efficient manner.

DETAILED DESCRIPTION OF THE INVENTION

Figure 1:
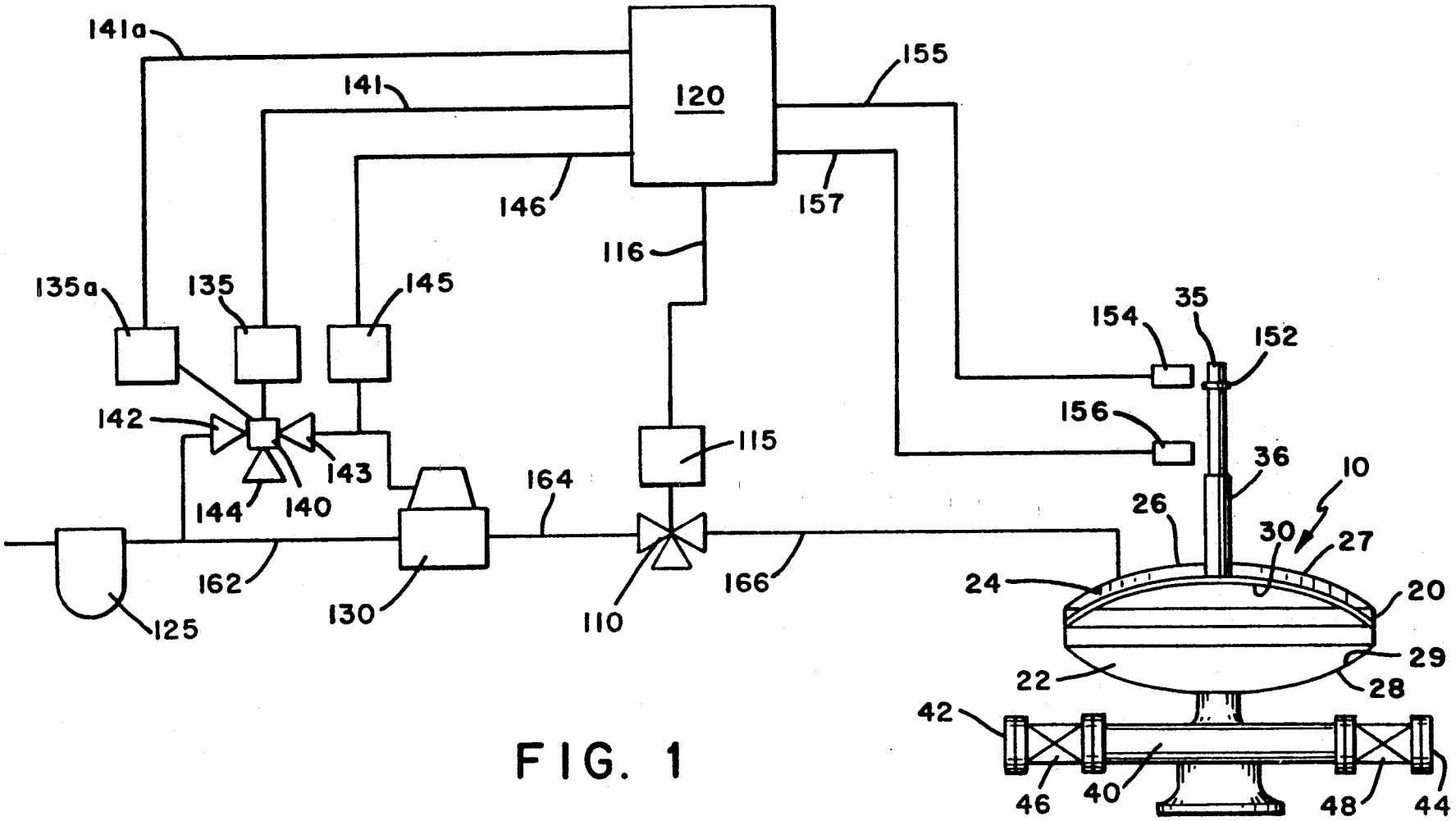
FIG. 1 is a schematic representation of a control system constructed in accordance with the principles of the present invention, such control system controlling the operation of a diaphragm pump.

FIG. 1 shows a schematic of the control system 100 utilized in combination with a diaphragm pump 10. The diaphragm pump includes a pump body 20 and a flexible diaphragm membrane 30 dividing the pump body into a pumping chamber 22 and a pump actuating chamber 24. The pump body 20 is constructed with an upper pump cover 26 and a lower pump body 28. As a result, the pumping chamber 22 comprises the space between the diaphragm membrane 30 and the inner wall 29 of the lower pump body 28, while the pump actuating chamber 24 comprises the space between the diaphragm membrane 30 and the inner wall 27 of the upper pump cover 26.

The pumping chamber 22 is in fluid communication with a fluid transporting duct 40 having an inlet 42 and an outlet 44. An inlet check valve 46 adjacent to the fluid ducts inlet 42 and an outlet check valve 48 adjacent to the fluid duct outlet 44 control the fluid flow through the fluid duct and insure that the diaphragm pump functions properly.

Application of air pressure into the pump actuating chamber 24 actuates the diaphragm membrane 30. The application of the air pressure causes the diaphragm membrane 30 to pump the fluid medium passing through the fluid transporting duct 40. An air valve 110, which is opened by a solenoid 115 controls the flow of the air pressure. The solenoid 115 is in turn activated by electrical signals transmitted through electrical cable 116 from the programmable logic controller 120.

The air pressure is preferably supplied from an air filter 125. The air filter 125 passes the air through the pilot controlled pressure regulator 130 to the air valve 110, and ultimately to the pump actuating chamber 24. It should be noted that the air pressure is transported from air filter 125 to the pilot controlled pressure regulator 130 by conduit 162, the air pressure is transported from pressure regulator 130 to air valve 110 by conduit 164, and the air pressure is transported from the air valve 110 to the pump actuating chamber 24 by conduit 166. The programmable logic controller 120 controls the pressure of the air passing through the pilot controlled pressure regulator 130. If increased pressure is desired, the controller 120 sends a signal through electrical cable 141*a* to the digitally controlled solenoid 135*a* which opens the pilot valve 140 to allow for the passage of air pressure from input valve member 142 to output valve member 143. This increases the pressure signal to the pilot controlled regulator 130 which increases the pressure supplied to pump activating chamber 24. In contrast, if a lower pressure level is desired, the controller 120 sends a signal through electrical cable 141*a* to the digitally controlled solenoid 135*a* which activates the pilot valve 140 to allow for the passage of air pressure from output valve member 143 to atmosphere valve member 144. This decreases the pressure signal to the pilot controlled regulator 130 which decreases the pressure supplied to pump activating chamber 24. If the signal sent by the programmable logic controller 120 will result in an unacceptably high pressure level, pressure switch 145 is activated to inhibit any further pressure increase by sending an appropriate signal through electrical cable 146.

The programmable logic controller 120 determines the necessity for increasing or decreasing the pressure applied to the pump actuating chamber 24 by measuring the discharge time of the diaphragm pump and comparing the measured time with a predetermined desired discharge time. A rod 35 is attached to the diaphragm membrane 30 and extends through a central opening 36 in the pump cover 26, and therefore through the pump activating chamber 24. It should be noted that only a small portion of the rod is contained within the pump body and the majority of the rod is outwardly exposed from the pump body 20. The rod 35 is secured to the diaphragm membrane 30 such that as the diaphragm membrane 30 is actuated to pump the fluid medium through the fluid transporting duct 40 the rod 35 moves up and down with the movement of the diaphragm membrane 30.

A proximity switch target 152 is secured to the exposed end of the rod 35. The proximity switch target 152 works in conjunction with an upper proximity switch 154 and a lower proximity switch 156 to measure the discharge time of the diaphragm pump 10 and to send an appropriate signal to the programmable logic controller 120. The signal produced by upper proximity switch 154 is transmitted to controller 120 by electrical cable 155, while the lower proximity switch sends its signal through electrical cable 157. In use, the upper proximity switch 154 indicates when the diaphragm member 30 is in its up position and the lower proximity switch 156 indicates when the diaphragm membrane 30 is in its lower position. This information is sent to the programmable logic controller 120 which then calculates the discharge time and sends the appropriate signals to the air valve solenoid 115 and the pilot controlled pressure regulator 130. It should be noted that although the proximity switches disclosed above are part of the preferred embodiment, they could be replaced with photoelectric switches or any other appropriate sensing device. Additionally, the proximity switch target 152 can be a piston of an air cylinder, a disk attached to the rod, or any other similar type device.

OPERATION

Before the pump 10 is placed into operation, the desired cycle time and discharge time are inputted into the programmable logic controller 120 The cycle time is the time desired for a complete pump cycle and is monitored during pump operation by a cycle timer within the controller. The discharge time is the time it takes for the diaphragm membrane 30 to go from its starting (up) position to its desired finishing (down) position.

The pump cycle consists of a discharge stroke and a fill cycle. The discharge stroke begins with the diaphragm membrane 30 in its up position against, or nearly against, the pump cover 26. At this point, the fluid medium to be pumped is located in the pumping chamber 22, and air at ambient pressure is located in the pump activating chamber 24. The discharge stroke begins when the air valve 110 is opened and air pressure is allowed to enter the pump activating chamber 24. The air pressure pushes the diaphragm membrane 30 down, thereby expelling the fluid medium contained in the pumping chamber 22 into the fluid transporting duct 40. Because the inlet check valve 46 will not allow the fluid medium to go through the inlet 42, the fluid medium is forced through the outlet check valve 48. Once the discharge stroke is completed, the air valve 110 is closed to allow the compressed air in the pump activating chamber 24 to escape and the pressure is returned to atmosphere. It should be noted that the air valve 110 is a 3-way valve. It is normally closed in its unenergized state. In its open position, air is allowed to pass from conduit 164 to conduit 166. In its closed position, air is allowed to pass from conduit 166 to the atmosphere. The fill stroke of the diaphragm pump 10 begins with the diaphragm membrane 30 returning to its starting (up) position. At this time, the movement of the diaphragm membrane 30 draws the fluid medium through the inlet check valve 46 and into the pumping chamber 22. Once the diaphragm membrane 30 reaches its starting position against, or nearly against, the pump cover 26, and the pumping chamber 22 is filled, the fill stroke is completed and the diaphragm pump 10 is ready to begin another cycle. However, the next discharge stroke will not begin until the cycle time of the programmable logic control 120 indicates that the predetermined cycle time has been reached. It should be noted that return of the diaphragm membrane 30 to its up position can be assisted by either a compressed spring or an air cylinder. However, in some applications it is not necessary to provide any assistance.

At the beginning of the pump cycle, the cycle timer starts, and the discharge begins, when the solenoid 115 is activated by the programmable logic controller 120 and the air valve 110 is opened. The cycle timer starts when the upper proximity switch 154 senses that the proximity switch target 152 is in its upper starting position. It should be noted that movement of the proximity switch target 152 is indicative of downward movement of the diaphragm membrane 30, because the target and the membrane are connected by the rod 35.

Opening of the air valve 110 allows the fluid pressure medium to enter the pump activating chamber 24 and produce the downward pumping stroke of the diaphragm membrane 30. The air valve 110 remains open until the diaphragm membrane 30 reaches its finishing (down) position. When the diaphragm membrane 30 reaches its finishing position, the proximity switch target 152 actuates the lower proximity switch 156 and a signal is sent to the programmable logic controller 120 to deactivate the solenoid 115 and close the air valve 110. If the diaphram 30 fails to reach its finishing (down) position after a fixed amount of time, the programmable controller 120 deactivates the solenoid 115 which closes the air valve 110.

At this point, the programmable logic controller 120 determines the time taken for the proximity switch target 152 to move between the upper proximity switch 154 and the lower proximity switch 156. This time is the actual discharge time for the diaphragm pump 10 and the programmable logic controller 120 compares it with desired discharge time that has previously been inputted into the programmable logic controller 120.

If the actual discharge time is greater than the desired discharge time, the pressure setting on the pilot controlled regulator 130 must be increased, and the programmable logic controller 120 sends a signal to the digitally controlled solenoid 135 to increase the pressure signal supplied to the pilot controlled regulator 130. In contrast, if the actual discharge time is less than the desired discharge time, the programmable logic controller 120 sends a signal to the digitally controlled solenoid 135*a* to decrease the pressure signal supplied to the pilot controlled regulator 130.

After the air valve 110 is closed the fill stroke begins. Once the fill stroke is completed, the diaphragm membrane 30 will stay in its starting position until the cycle timer reaches the previously inputted desired cycle time. When the desired cycle time is reached, the pump cycle will repeat itself.

It should be noted that an external signal can be supplied to the controller to shut down the pump at any time. Additionally, the pressure switch 145 can be used to shut down the pump if the pressure reaches too high a level.

What is claimed is:

1. A control system for an air actuated diaphragm pump comprising:

a diaphragm pump including a pump housing, a diaphragm dividing the housing into a pumping chamber and a pump actuating chamber;

an air pressure supply source communicating with said pump actuating chamber to introduce air under pressure into the pump actuating chamber to force the diaphragm from a starting position to a finishing position;

a three-way supply valve for controlling the introduction of air pressure into the pump actuating chamber, said three-way supply valve capable of venting the pump actuating chamber to atmosphere;

a pressure regulator for limiting the air pressure;

stroke sensing means for sensing movement of the diaphragm between a starting position and a finishing position;

central control means for coordinating the operation of said valve and said pressure regulator in response to signals received from said stroke sensing means, wherein the central control means adjusts the pressure regulator in accordance with variations in the discharge time of the pump.

2. A control system according to claim 1, wherein the stroke sensing means comprises:

an actuating rod that extends from said diaphragm through an opening in the pump actuating chamber;

a proximity target secured to said actuating rod;

an upper proximity switch in communication with the central control means, wherein said upper proximity switch senses the proximity target when the diaphragm is in its start position;

a lower proximity switch in communication with the central control means, wherein said upper proximity switch senses the proximity target when the diaphragm is in its finishing position;

wherein the discharge time for the pump is measured by said central control means when the proximity target moves from the upper proximity target to the lower proximity target.

3. A control system according to claim 1, wherein the central control means stores a desired discharge time, such that when the discharge time for the pump exceeds the desired discharge time and central control means increases the pressure signal supplied to the pressure regulator.

4. A control system according to claim 1, wherein the central control means stores a desired discharge time, such that when the discharge time for the pump is less than the desired discharge time the central control means decreases the pressure signal supplied to the pressure regulator.

5. A control system according to claim 1, wherein the central control means maintains a cycle timer which sets the duration of the cycle for the pump, such that at the beginning of the cycle of the pump the central control means opens the supply valve to permit air pressure to flow into the pump actuating chamber.

6. A control system according to claim 2, wherein the supply valve is closed when the lower proximity switch senses the proximity target.

7. A method for controlling an air actuated diaphragm pump, having a pump cycle including a discharge stroke and a fill stroke, comprising the steps of:

a) setting a desired discharge time and a starting air pressure for the diaphragm pump;

b) beginning the discharge stroke of the diaphragm pump;

c) measuring the duration of the actual discharge stroke;

d) comparing the actual discharge stroke with the desired discharge stroke, and e) adjusting the air pressure so that a subsequent discharge stroke will have a duration equal to the desired discharge time.

8. A method according to claim 7, further comprising the steps of setting a desired cycle time, and repeating steps (a) through (e) for each cycle.

9. A control system adapted for use with a pneumatically actuated pump including a diaphragm pump including a pump housing, a diaphragm dividing the housing into a pumping chamber and a pump actuating chamber wherein the control system comprises:

an air pressure supply source adapted to introduce air pressure into the pump actuating chamber to force the diaphragm from a starting position to a finishing position;

a three-way supply valve adapted to control the introduction of air pressure into the pump actuating chamber, said three-way valve capable of venting the pump actuating chamber to atmosphere;

a pressure regulator for limiting the air pressure;

stroke sensing means for sensing movement of the diaphragm between a starting position and a finishing position;

a central control system for coordinating the operation of said valve and said pressure regulator in response to signals received from said stroke sensing means;

pressure adjustment means for said pressure regulator comprising a solenoid-operated three-way valve in communication with said central control system and positioned in a branch conduit connecting said air pressure source to said pressure regulator for communicating pressure signals to said pressure regulator, means for venting signal pressure at said pressure regulator to atmosphere to decrease the pressure signal, the central control system adjusting the pressure regulator in accordance with variations in the discharge time of the pump.

* * * * *

UNITED STATES PATENT AND TRADEMARK OFFICE

CERTIFICATE OF CORRECTION

PATENT NO. : 5,252,041

DATED : October 12, 1993

INVENTOR(S) : Russell Schumack

It is certified that error appears in the above-identified patent and that said Letters Patent is hereby corrected as shown below:

In Column 1, Line 29, please delete "operation" and substitute therefor - - operator - -.

In Column 2, Line 10, please delete "Ruoo" and substitute therefor - - Rupp - -.

In Column 4, Line 23, please insert - - . - - after "120".

In Column 5, Line 29, please insert - - , - - after "10".

In Column 5, Line 44, please insert - - , - - after "closed".

In the Claims:

In Column 6, Line 24, please delete "upper" and substitute therefor - - lower - -.

In Column 6, Line 34, please insert - - , - - after "time" and please delete "and" and substitute therefor - - the - -.

In Column 6, Line 40, please insert - - , - - after "time".

Signed and Sealed this

Third Day of May, 1994

Bruce Lehman

*Attest:*

BRUCE LEHMAN

*Attesting Officer*

*Commissioner of Patents and Trademarks*